US009799468B2

(12) United States Patent
Magoni et al.

(10) Patent No.: US 9,799,468 B2
(45) Date of Patent: Oct. 24, 2017

(54) SUPPORT ASSEMBLY FOR A MICRO-SWITCH OF A SWITCHING DEVICE

(71) Applicant: ABB Technology AG, Zurich (CH)

(72) Inventors: Stefano Magoni, Osio Sotto (IT); Andrea Farina, Monza (IT)

(73) Assignee: ABB Schweiz AG, Baden (CH)

( * ) Notice: Subject to any disclaimer, the term of this patent is extended or adjusted under 35 U.S.C. 154(b) by 76 days.

(21) Appl. No.: 14/791,957

(22) Filed: Jul. 6, 2015

(65) Prior Publication Data

US 2015/0311015 A1 Oct. 29, 2015

Related U.S. Application Data

(63) Continuation of application No. PCT/EP2013/050058, filed on Jan. 3, 2013.

(51) Int. Cl.

| | |
|---|---|
| ***H01H 1/64*** | (2006.01) |
| ***H01H 9/02*** | (2006.01) |
| ***H01H 19/08*** | (2006.01) |
| ***H01H 9/00*** | (2006.01) |
| ***H01H 19/60*** | (2006.01) |
| ***H01H 71/46*** | (2006.01) |
| ***H01H 71/02*** | (2006.01) |

(52) U.S. Cl.

CPC ..... *H01H 19/08* (2013.01); *H01H 9/0066* (2013.01); *H01H 19/60* (2013.01); *H01H 71/025* (2013.01); *H01H 71/465* (2013.01)

(58) Field of Classification Search

CPC .... H01H 19/08; H01H 71/025; H01H 9/0066; H01H 19/60; H01H 71/465

USPC ..... 200/293, 335, 336, 564, 568, 573, 574

See application file for complete search history.

(56) References Cited

U.S. PATENT DOCUMENTS 5,552,570 A * 9/1996 Shinohara ..... H01H 21/285 200/293

5,823,323 A 10/1998 Seymour et al.

(Continued)

FOREIGN PATENT DOCUMENTS

| | | |
|---|---|---|
| EP | 2 028 674 A2 | 2/2009 |
| FR | 2 699 324 A1 | 6/1994 |
| KR | 101 212 213 B1 | 12/2012 |

OTHER PUBLICATIONS

International Search Report (PCT/ISA/210) mailed on Sep. 26, 2013, by the European Patent Office as the International Searching Authority for International Application No. PCT/EP2013/050058.

*Primary Examiner* — Renee Luebke
*Assistant Examiner* — Lheiren Mae A Caroc
(74) *Attorney, Agent, or Firm* — Taft Stettinius & Hollister LLP

(57) ABSTRACT

A support-assembly suitable for a micro-switch of a switching device, including bracket-support-means suitable for being connected, in a stationary position, to a frame portion of the switching-device, coupling-protrusion-component shaped for being provided at an end of an operating-shaft of the micro-switch and for movably engaging with the bracket-support-component. The coupling-protrusion-component and the bracket-support-component being configured for enabling a rotation of the operating-shaft around a rotation-axis and for preventing a movement of the operating-shaft transversely to the rotation-axis.

20 Claims, 3 Drawing Sheets

(56) References Cited

U.S. PATENT DOCUMENTS

| | | | | |
|---|---|---|---|---|
| 2009/0051470 | A1 | 2/2009 | Yang et al. | |
| 2012/0325628 | A1* | 12/2012 | Besana | H01H 9/167 200/43.14 |
| 2013/0015928 | A1 | 1/2013 | Sohn | |

* cited by examiner

SUPPORT ASSEMBLY FOR A MICRO-SWITCH OF A SWITCHING DEVICE

RELATED APPLICATION(S)

This application claims priority as a continuation application under 35 U.S.C. §120 to PCT/EP2013/050058 filed as an International Application on Jan. 3, 2013 and designates the U.S. The entire content of which is hereby incorporated by reference.

FIELD

The present disclosure relates to a support assembly for a micro-switch, in particular for a rotative micro-switch acting as auxiliary contact of a switching device.

BACKGROUND INFORMATION

Known micro-switches act as an auxiliary contact within a switchgear and function to monitor, indicate, and control closing/opening manoeuvres of a circuit breaker. Such a micro-switch is of the linear type, e.g., operates according to a linear working principle. In other words, an operating-shaft of the micro-switch is linearly moved by a driving-mechanism in determined operating conditions, such as a fault or other particular events. Although such a micro-switch performs in a quite satisfying way, it would be desirable and advantageous, for some configurations of switching device/switchgear installations which will be get diffused in the future, to make use of a rotative micro-switch for the auxiliary-contact-function, where such a rotative micro-switch includes a rotary shaft operating according to a rotative working principle. However, due to high performance of the circuit breaker, for example, due to sudden and rapid closing/opening electrical manoeuvres, such a rotary shaft receives high driving forces and undergoes severe stress even greater than in the case of a linear micro-switch shaft. Therefore, it would be desirable making possible to take advantage of a rotative micro-switch while at the same time preventing any possible damage of the respective rotary shaft due to high driving forces exerted by a lever-mechanism, for example, by providing a technical solution which is at the same time cheap and simple.

This is achieved by a support assembly as defined in the appended claims and described hereinafter in details, which is able to overcome the abovementioned drawback.

SUMMARY

An exemplary support-assembly suitable for a micro-switch of a switching device is disclosed comprising: bracket-support-means suitable for connection, in a stationary position, to a frame portion of said switching-device; coupling-protrusion-means shaped for positioning at an end of an operating-shaft of said micro-switch and for movably engaging with said bracket-support-means; and said coupling-protrusion-means and said bracket-support-means are configured to enable rotation of said operating-shaft around a rotation-axis and to prevent movement of said operating-shaft transversely to said rotation-axis.

BRIEF DESCRIPTION OF THE DRAWINGS

The present disclosure can be better understood and implemented with reference to the attached drawings that illustrate an embodiment thereof by way of a non-limiting example, in which.

DETAILED DESCRIPTION

Figure 1:
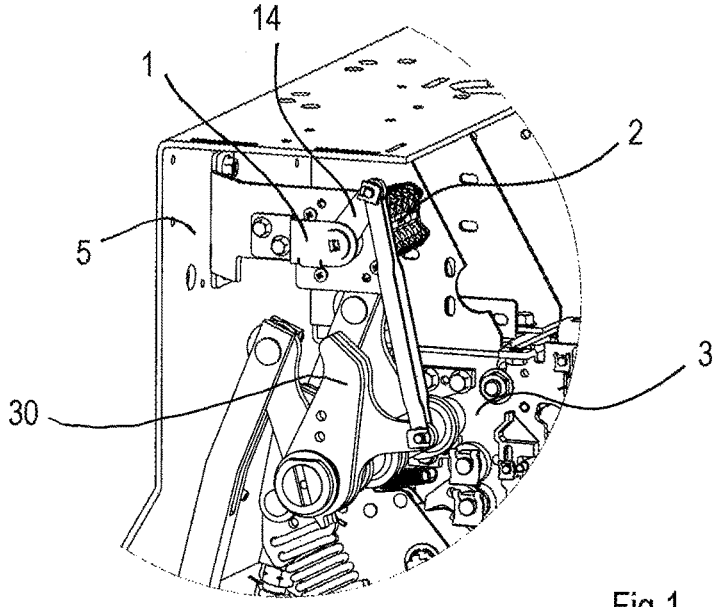
FIG. 1 is a fragmentary perspective view of a switching device provided with a rotative micro-switch which is connected to a support-assembly according to an exemplary embodiment of the disclosure.
Figure 2:
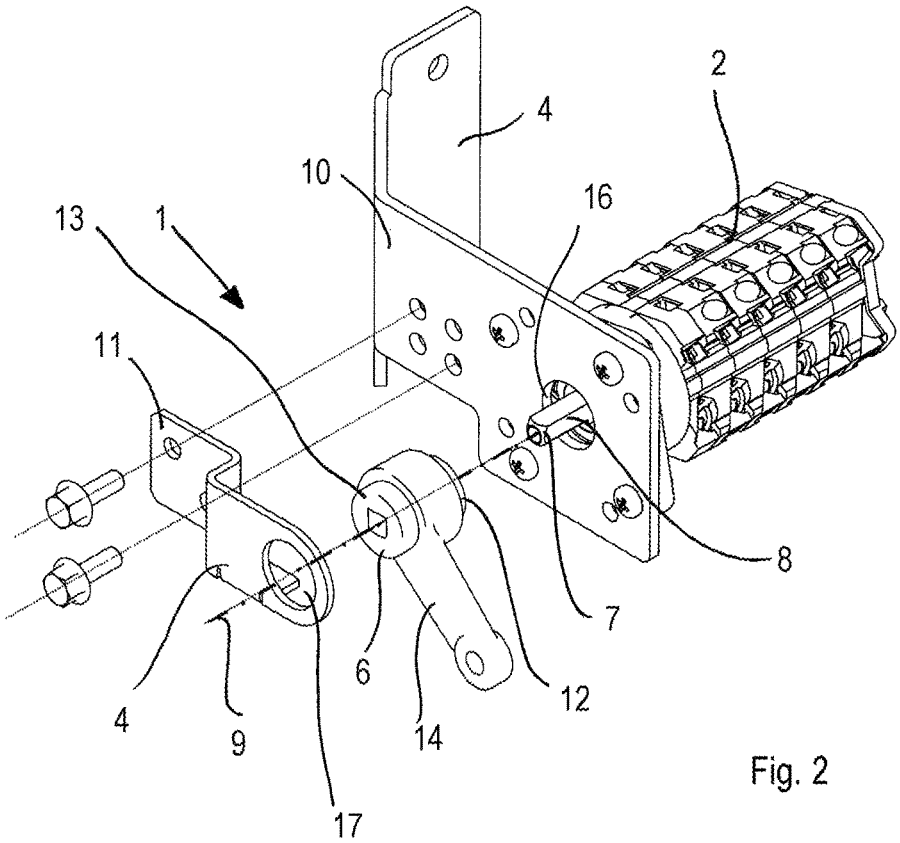
FIG. 2 is an exploded view of the support assembly associated to the micro-switch of FIG. 1 according to an exemplary embodiment of the disclosure.
Figure 4:
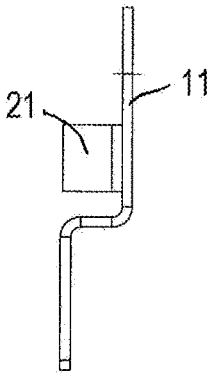
FIGS. 3, 4, and 5 show different perspective view of a part of bracket-support-means included in the support assembly according to an exemplary embodiment of the present disclosure.
Figure 3:
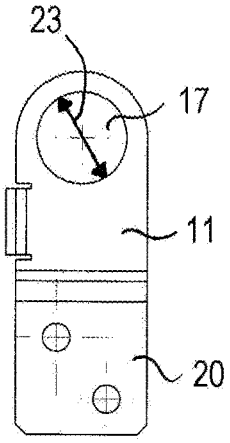
Figure 5:
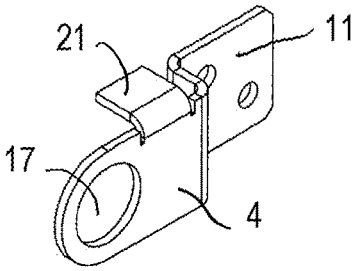
Figure 6:
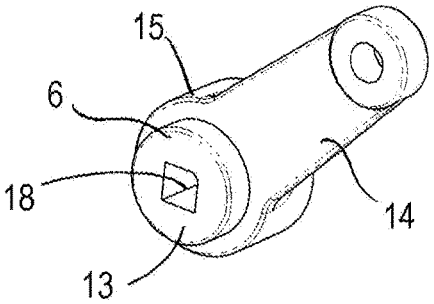
FIGS. 6 and 7 are different views of a lever for the micro-switch shaft provided with coupling-protrusion-means included in the support assembly according to an exemplary embodiment of the disclosure.
Figure 7:
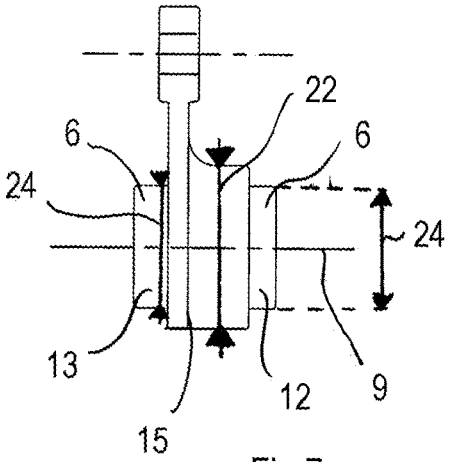
Figure 10:
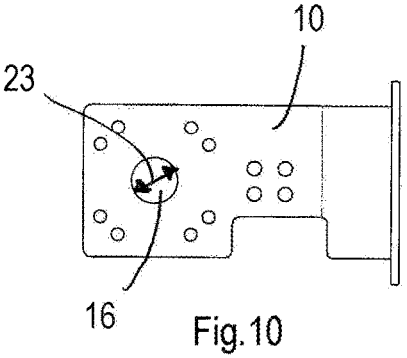
FIGS. 8, 9, and 10 show different perspective views of a further part of bracket-support-means included in the support assembly according to an exemplary embodiment of the disclosure.
Figure 8:
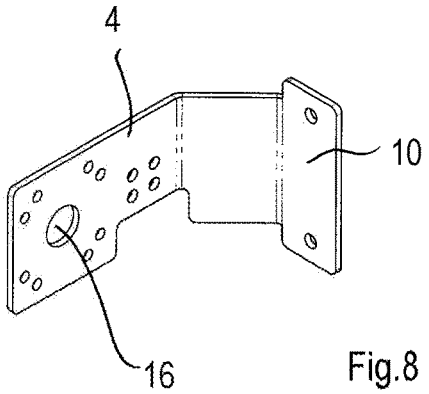
Figure 9:
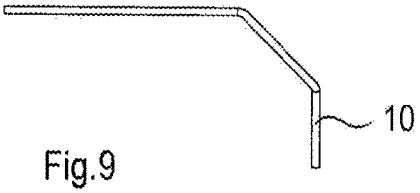
Figure 12:
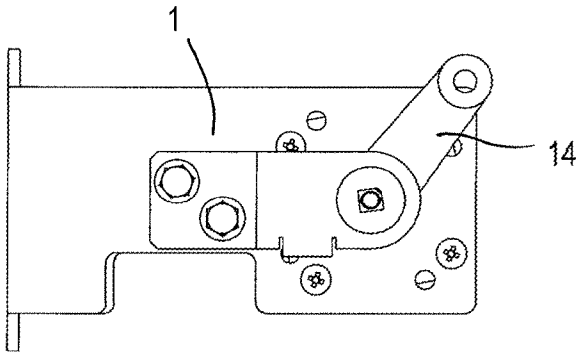
FIGS. 11 and 12 show the micro-switch and the support-assembly in an assembled configuration and in a first operative position according to an exemplary embodiment of the disclosure.
Figure 14:
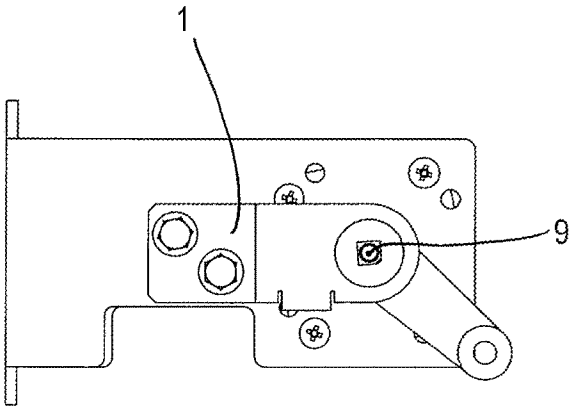
FIGS. 13 and 14 show the mutually assembled micro-switch and support-assembly in a second operative position according to an exemplary embodiment of the disclosure.
Figure 11:
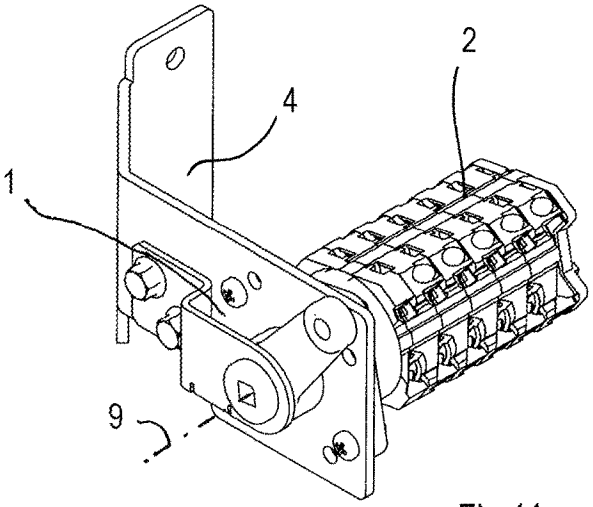
Figure 13:
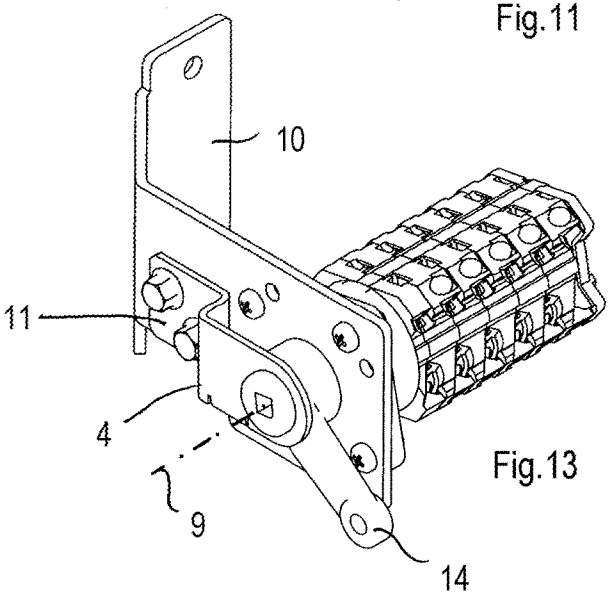

Exemplary embodiments of the present disclosure are directed to an auxiliary rotative micro-switch including the support assembly, a switching device, such as a circuit breaker, including said auxiliary rotative micro-switch and a switchgear, described herein as a panel, cabinet, or switchboard, including the support assembly. Characteristics and advantages of the present disclosure will result from the description and from claims.

With reference to the attached Figures, a support assembly 1 is shown which is suitable for a micro-switch 2, for example, a rotative micro-switch 2 of a switching device, such as a circuit breaker 3, housed within a medium voltage switchgear. For the purposes of the present application, the term medium voltage refers to applications in the range from 1 kV up to some tens of kV, for example 36 kV.

The micro-switch 2 has an auxiliary contact function and acts for monitoring, for indicating/signalling an operating status of the circuit breaker 3 (for example an overcurrent or a short circuit condition), and for controlling the latter, e.g., to enable/disable an electrical closing/opening procedure thereof.

The micro-switch 2 includes a rotary operating shaft 8 which is configured for operating according to a rotary working principle. In other words, the rotary operating shaft 8 is rotatable between two angular positions in order to put the micro-switch 2 in an electrical closed and open position respectively in concomitance of determined operating conditions, such as a fault, a short circuit or other particular events.

The rotary operating shaft 8 is rotatable, around a rotation-axis 9, through a lever 14 which in turn is moved by a driving mechanism 30 (FIG. 1).

The support-assembly 1 described in the following is configured for protecting and preserving the rotary operating shaft 8 from possible damages, for example, during operation of the circuit breaker 3 in a mechanical type test.

The support-assembly 1 includes bracket-support-means (e.g., component, assembly) 4, described in detail in the following, which are suitable for being connected, in a stationary position, to a frame portion 5 of the switching device, in this exemplary and not limitative case, the circuit breaker 3. The support-assembly 1 further includes coupling-protrusion-means (e.g., component, assembly) 6 which, in an assembled operating configuration, are positioned at a free end 7 of the rotary operating-shaft 8 of the micro-switch 2 and which are adapted for movably engaging with the bracket-support-means 4. The bracket-support-means 4 and the coupling-protrusion-means 6 are described in detail in the following. The bracket-support-means 4 are adapted for enabling a pivotal-movement of the coupling-protrusion-means 6, and thus of the rotary shaft 8, around the rotation-axis 9 and for preventing a movement of the coupling-protrusion-means 6, and therefore of the rotary shaft 8, transversely to the rotation-axis 9.

The coupling-protrusion-means 6 of the support-assembly 1 are obtained on a connecting-portion 15 of the lever 14. In the exemplary and not limitative version shown in the Figures, the coupling-protrusion-means 6 are an integral part of the connecting-portion 15. In other words, the coupling-protrusion-means 6 are integral with the lever 14, e.g., they are directly obtained by pressing or moulding the lever 14, or are obtained by tooling, for example by chip-forming-machining the lever 14. On the connecting portion 15 a fitting opening 18 is obtained for the connection to the end 7 of the rotary shaft 8, having for example a square cross-section. In a further possible version, the lever 14 together with the coupling-protrusion-means 6 are integral with the rotary shaft 8 thus defining a single-piece-element suitable for being assembled to, and inserted in the micro-switch 2.

In a further possible embodiment of the support assembly, the coupling-protrusion-means 6 can be configured as separated elements to be fixed to the connecting portion 15 of a known lever 14, in order to achieve the pivotal coupling with the bracket support means 4.

In the exemplary and not limitative version here shown and described, the coupling-protrusion-means 6 includes a first coupling-portion 12 and a second coupling-portion 13, provided at opposite sides on the connecting-portion 15 of the lever 14, and the bracket-support-means 4 includes a first-bracket-element 10 and a second bracket-element 11 adapted for engaging with the first coupling-portion 12 and with the second coupling-portion 13, respectively.

For example, the first coupling-portion 12 and the second coupling-portion 13 protrude from the connecting-portion 15 in opposite directions, with a cylindrical shape, and are adapted for pivotally coupling with a first seat-opening 16 and with a second seat-opening 17 respectively obtained on the first bracket element portion 10 and on the second bracket element portion 11. The first bracket-element 10 includes a bent-shaped-plate element including a base-portion 19 intended to be applied to the frame portion 5.

The second bracket-element 11 includes a fixing-portion 20 adapted for being fixed on the first bracket-element 10, and a stop-protrusion 21 configured for limiting a rotation movement of the lever 14 which, as it can be seen in FIGS. 11 to 14, is rotatable between two angular positions.

The first coupling-portion 12 and the second coupling-portion 13 have an external diameter 24, which can be the same or alternatively different from one another, but which is less than a width-dimension 22 of the connecting portion 15; the width-dimension 22 is measured transversely to the rotation-axis 9 in the assembled configuration of the support-assembly 1.

The first seat-opening 16 and the second seat-opening 17 are shaped as through-openings having a diameter 23 which is less than the width-dimension 22 of the connecting-portion 15, and which is chosen for adapting to the external diameter 24 of the respective first coupling portion 12 and second coupling portion 13.

Due to the above described structural configuration, for example, due to the engagement of the first coupling-protrusion 12 and of the second coupling-protrusion 13 with the first seat-opening 16 and the second seat-opening 17 respectively of the first bracket element 10 and second bracket element 11, any movement of the shaft end 7 transversely to the rotation axis 9 is prevented. This means that any possible flexure and bending stress on the shaft 8, due to vigorous and sudden action by the driving-linking-mechanism 30, is avoided, thus preserving the shaft from damages such as fatigue-break.

Furthermore, the first bracket element 10 and the second bracket element 11 prevent, from respective opposite sides, a movement of the connecting portion 22 of the lever 14 parallel to the rotation axis 9. In conclusion, only a pivotal movement of the lever 14, and thus of the rotary shaft 8 around the rotation axis 9 is allowed.

The support-assembly 1 allows the rotary shaft 8 to be pivotally driven in a safety mode. In other words, the movement of the rotary shaft 8 has only an angular component, while normal forces that may damage the shaft are compensated by the support-assembly 1. The high forces exerted on the lever 14 are taken by the bearing support-assembly 1, due to its structural configuration, while the rotary shaft 8 is safely moved with no mechanical problems.

Due to the support assembly 1, all standard specifications are met, and mechanical strength tests on rotative micro-switches connected to circuit breaker are successfully passed. The rotative micro-switch 2, due to the support assembly 1, is thus in conditions to lastingly operate in a correct, precise and reliable way. A correct positioning of the rotary shaft 8, and thus a precise closing/opening operation of the micro-switch 2, is ensured.

It has been described how any switching manoeuvres are reliably performed by using a micro-switch 2 of the rotary type due to the support-assembly 1 according to the disclosure, which is a technical solution that is inexpensive and lacks complexity.

The support-assembly 1 can be modified or varied all within the scope of the novel concept as defined by the appended claims and the described exemplary embodiments. Any details, features, or components of the exemplary embodiments may be replaced with technically equivalent elements.

One or more of the elements above described may be differently shaped and/or positioned, can be realized in one or more pieces or differently coupled or positioned as desired.

In practice, the materials, so long as they are compatible with the specific use, as well as the individual components, may be any according to the requirements and the state of the art.

Thus, it will be appreciated by those skilled in the art that the exemplary embodiments of the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

What is claimed is:

1. A support-assembly suitable for a micro-switch of a switching device comprising:

bracket support means suitable for connection, in a stationary position, to a frame portion of said switching-device;

coupling protrusion means shaped for positioning at an end of an operating-shaft of said micro-switch and for movably engaging with said bracket support means; and said coupling protrusion means and said bracket support means are configured to enable rotation of said operating-shaft around a rotation-axis and to prevent movement of said operating-shaft transversely to said rotation-axis;

wherein said bracket support means includes a first bracket-element and a second bracket-element adapted for engaging with a first coupling-portion and with a second coupling-portion of said coupling protrusion means respectively.

2. The support-assembly according to claim 1, wherein said bracket support means are adapted to enable pivotal-movement of said coupling protrusion means around said rotation-axis and to prevent movement of said coupling protrusion means parallel to said rotation-axis.

3. The support-assembly according to claim 2, wherein said coupling protrusion means are positioned on a connecting-portion of a lever for driving said operating-shaft.

4. The support-assembly according to claim 3, wherein said first coupling-portion and said second coupling-portion are provided at opposite sides on said connecting-portion of said lever, and are configured for pivotally coupling with a first seat-opening and with a second seat-opening, respectively, which are positioned on said first bracket-element and on said second bracket-element.

5. The support-assembly according to claim 4, wherein each of said first seat-opening and said second seat-opening include a through-opening having a respective diameter which is less than a width-dimension of said connecting-portion, said width-dimension being measured transversely to said rotation-axis in an assembled configuration.

6. The support-assembly according to claim 5, wherein said first coupling-portion and said second coupling-portion are integral with said connecting-portion, protrude with a cylindrical shape, and have each an external diameter which is less than said width-dimension.

7. The support-assembly according to claim 6, wherein a fitting-opening is obtained on said connecting-portion for coupling with said end of said operating-shaft.

8. The support-assembly according to claim 6, wherein said lever together with said coupling protrusion means are integral with said operating-shaft to define a single-piece-element suitable for being assembled to said micro-switch.

9. The support-assembly according to claim 8, wherein said first bracket-element includes a bent-shaped-plate element including a base-portion suitable for being applied to said frame portion.

10. The support-assembly according to claim 9, wherein a second bracket-element includes:

a fixing-portion adapted for being fixed on a first bracket-element; and a stop-protrusion configured for limiting a rotation movement of said lever.

11. The support-assembly according to claim 1, wherein said coupling protrusion means are positioned on a connecting-portion of a lever for driving said operating-shaft.

12. The support-assembly according to claim 1, wherein said first coupling-portion and said second coupling-portion are provided at opposite sides on a connecting-portion of a lever, and are configured for pivotally coupling with a first seat-opening and with a second seat-opening, respectively, which are positioned on said first bracket-element and on said second bracket-element.

13. The support-assembly according to claim 12, wherein each of said first seat-opening and said second seat-opening include a through-opening having a respective diameter which is less than a width-dimension of said connecting-portion, said width-dimension being measured transversely to said rotation-axis in an assembled configuration.

14. The support-assembly according to claim 12, wherein said first coupling-portion and said second coupling-portion are integral with said connecting-portion, protrude with a cylindrical shape, and have each an external diameter which is less than said width-dimension.

15. The support-assembly according to claim 12, wherein a fitting-opening is obtained on said connecting-portion for coupling with said end of said operating-shaft.

16. The support-assembly according to claim 1, wherein a lever together with said coupling protrusion means are integral with said operating-shaft to define a single-piece-element suitable for being assembled to said micro-switch.

17. The support-assembly according to claim 1, wherein said first bracket-element includes a bent-shaped-plate element including a base-portion suitable for being applied to said frame portion.

18. The support-assembly according to claim 1, wherein said second bracket-element includes:

a fixing-portion adapted for being fixed on said first bracket-element; and a stop-protrusion configured for limiting a rotation movement of a lever.

19. A kit comprising:

a support-assembly suitable for a micro-switch of a switching device comprising:

bracket support means suitable for connection, in a stationary position, to a frame portion of said switching-device;

coupling protrusion means shaped for positioning at an end of an operating-shaft of said micro-switch and for movably engaging with said bracket support means; and said coupling protrusion means and said bracket support means are configured to enable rotation of said operating-shaft around a rotation-axis and to prevent movement of said operating-shaft transversely to said rotation-axis; and a lever provided with said coupling protrusion means, suitable for being connected to the operating-shaft of a rotative micro-switch.

20. A switchgear apparatus comprising a switching device comprising a micro-switch comprising a support assembly, the support assembly comprising:

bracket support means suitable for connection, in a stationary position, to a frame portion of said switching-device;

coupling protrusion means shaped for positioning at an end of an operating-shaft of said micro-switch and for movably engaging with said bracket support means; and said coupling protrusion means and said bracket support means are configured to enable rotation of said operating-shaft around a rotation-axis and to prevent movement of said operating-shaft transversely to said rotation-axis; and wherein said switching device includes a circuit breaker, and said micro-switch is a rotative micro-switch with an auxiliary contact function.

* * * * *